US006925268B2

(12) United States Patent
Dougherty et al.

(10) Patent No.: US 6,925,268 B2
(45) Date of Patent: Aug. 2, 2005

(54) ESTIMATING TONER LEVELS

(75) Inventors: Patrick S. Dougherty, Boise, ID (US); Santiago Rodriguez, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 118 days.

(21) Appl. No.: 10/393,837

(22) Filed: Mar. 21, 2003

(65) Prior Publication Data

US 2004/0218936 A1 Nov. 4, 2004

(51) Int. Cl.[7] ..... G03G 15/08
(52) U.S. Cl. ..... 399/27; 347/140
(58) Field of Search ..... 399/24, 27, 30, 399/53, 58, 61, 62; 347/140

(56) References Cited

U.S. PATENT DOCUMENTS 5,802,420 A * 9/1998 Garr et al. ..... 399/27
6,456,802 B1 * 9/2002 Phillips ..... 399/27
6,459,861 B1 * 10/2002 Sakurai et al. ..... 399/27
6,510,294 B1 * 1/2003 Hakamada ..... 399/58
6,516,160 B1 * 2/2003 Rodriguez ..... 399/27

* cited by examiner

*Primary Examiner*—Sandra L. Brase

(57) ABSTRACT

Estimating toner levels. A method embodiment includes maintaining a running pulse width count, sensing a toner level, and comparing the running pulse width count with an expected pulse width count to estimate a toner level. If the estimated toner level deviates from the sensed toner level, the running pulse width count and the sensed toner level are used to estimate the remaining toner level.

30 Claims, 5 Drawing Sheets

ESTIMATING TONER LEVELS

BACKGROUND OF THE INVENTION

This invention relates to managing a printer's consumables. More particularly, the invention is directed to estimating environmental conditions in order to more accurately predict when a printer will run out of a consumable such as toner.

It is generally known that electrophotographic printers utilize toner to generate text and/or images on a print medium, such as, paper. In this regard, a toner cartridge is typically employed to store a fixed amount of toner. When toner runs out in the middle of a print job, paper and time may be wasted, and users may become frustrated. Thus, when there is insufficient toner to complete a print job, it is desirable to provide a means for warning a user before printing is started. To assist in this goal, sensors are often utilized to measure the toner level in a cartridge. However, sensors are expensive, so methods for estimating toner usage are also employed.

Previous inventions have disclosed methods of estimating toner usage for a print job. Typically, the toner usage is estimated for each print job. If the estimate indicates that insufficient toner is remaining in the cartridge, a user may be notified. For example, U.S. Pat. No. 5,802,420 discloses a method of predicting toner usage based upon printing history. If a certain amount of toner was used to print the last 10 pages, the next 10 pages is estimated to use that same amount. U.S. Pat. No. 5,937,255 discloses a method of estimating toner usage based upon a pixel count. For example, if "T" amount of toner is used to generate one pixel, then 100 pixels is estimated to use 100×T amount of toner.

However, different pixels may not require the same amount of toner. An electrophotographic printer scans a light beam across the surface of an optical photoreceptor ("OPR"). To create a pixel, the light beam is modulated (or pulsed) to illuminate a desired pixel location. However, the pixel does not represent a fixed quantity of toner. For each pulse, the length of time (or duration) the light source is on as it scans across the OPR correlates to the width of the pulse on the OPR surface. The width and number of pulses used to create a pixel may vary from one pixel to another. For example, to produce certain fine details, it may be advantageous to produce relatively narrow pixels. Thus, the duration of the pulse used to create the relatively narrow pixel is be correspondingly short. Conversely, a pulses of a relatively longer durations are used to produce a substantially solid line.

Even for a given sized pixel, the amount of toner used may vary from pixel to pixel. For example, the number of pulses used to create a pixel may differ from pixel to another. A first pixel may be produced with a single pulse. A second pixel may be produced with more than one pulse. However, the first and second pixels may be substantially the same size despite using varying amount of toner based on the number and duration of each pulse.

The durations of the pulses required to produce pixels can be summed into a running pulse width count (RPWC). The RPWC is a measure of the accumulated duration of pulses over a given time period and can be used to more accurately estimate toner usage. In a controlled environment, a pulse of a set duration—one millisecond for example—requires a known amount of toner. Using this information and the capacity of a toner cartridge, the RPWC value required to deplete all toner in the cartridge can be determined. For example, a printer may require 0.0001 grams of toner for a pulse width of one millisecond. Where the same printer uses a cartridge that stores 100 grams of toner, the RPWC should obtain a value of 1,000,000 seconds by the time the toner is depleted. In other words, the expected pulse width count (EPWC) for the toner cartridges is 1,000,000.

By setting the RPWC to zero when a new cartridge is installed, the amount of toner remaining in the cartridge can be estimated. Using the example above, when the RPWC reaches 500,000, half of the toner should be gone. However, estimation of the rate of toner usage for a given RPWC value presumes a controlled environment with a set ambient temperature and set relative humidity. Variations in either the temperature or humidity cause more or less toner to be consumed for the same RPWC value. To improve printer quality, variations in environmental conditions should be taken into account when estimating toner usage.

DETAILED DESCRIPTION OF THE INVENTION

Figure 1:
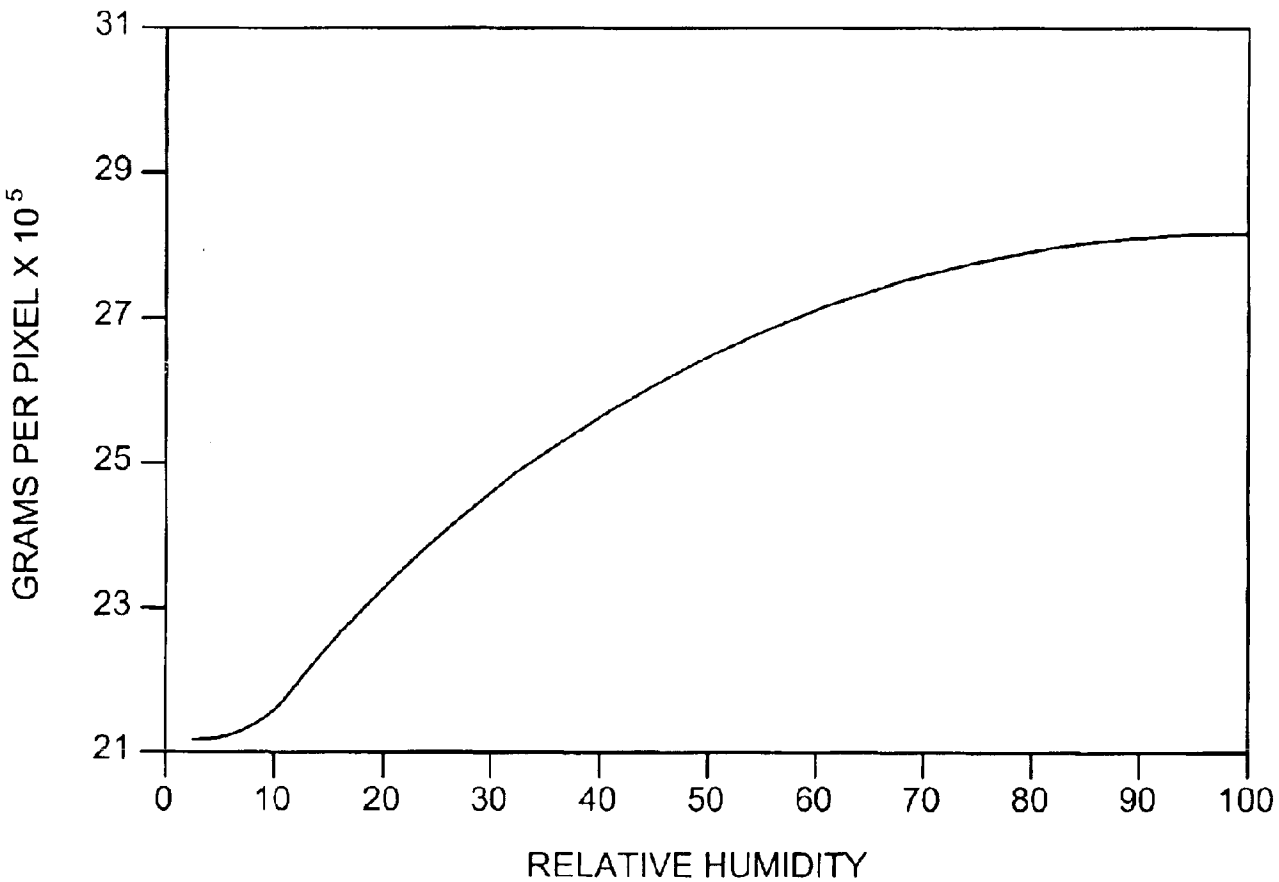
FIG. 1 is an exemplary graph illustrating the effect of humidity on toner consumption.

INTRODUCTION: To more accurately estimate toner consumption, environmental factors need to be taken into account. For a given pulse width, varying the environmental conditions affecting a printer results in a non linear amount of toner transfer. FIG. 1 illustrates the effect humidity can have on toner consumption. As the humidity increases, the toner required to produce a pixel also increases but in a non-linear fashion.

Application Ser. No. 09/977,688, filed Oct. 16, 2001 and entitled: "Correction of Pulse Width Accumulator Based On The Temperature And Relative Humidity," discusses using sensors to detect environmental conditions such as temperature and humidity and adjusting the RPWC accordingly in order to more accurately estimate toner levels. Adding sensors to measure environmental factors increases production costs. The present invention allows environmental conditions to be inferred rather than sensed in order to improve printer quality with less affect on the manufacturer's pocketbook.

The following description is broken into sections. The first section describes an environment in which the present invention may be implemented. The second section describes the physical and logical components of the devices operating in that environment. The third section describes steps taken to practice the present invention.

Figure 2:
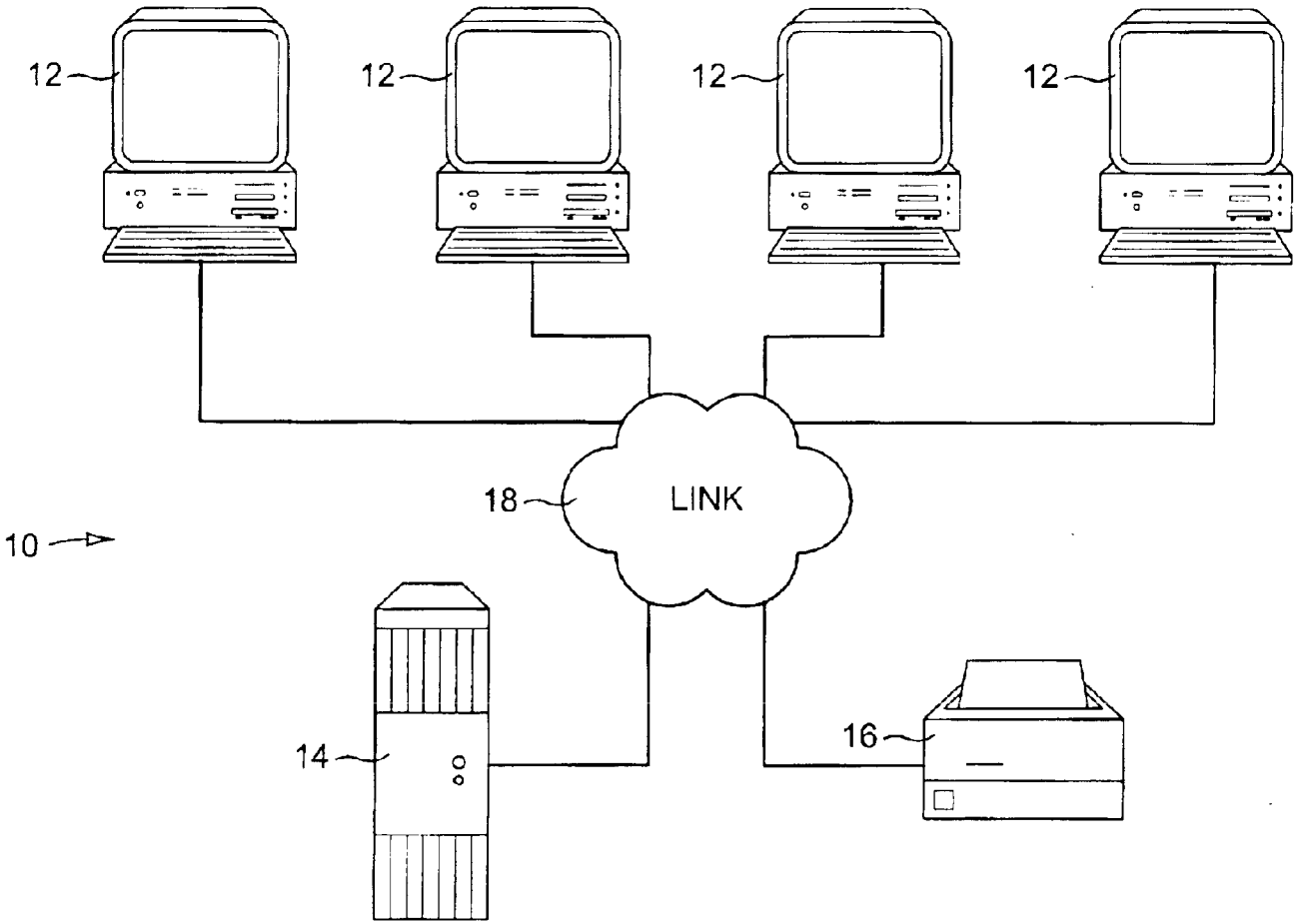
FIG. 2 is a schematic representation of a potential computing environment in which embodiments of the present invention may be incorporated.

ENVIRONMENT: FIG. 2 illustrates a printing environment 10 in which it would be advantageous to implement the present invention. Environment 10 includes client work stations 12, print server 14, and printer 16. Work stations 12 represent generally any computing device such as a desktop computer, laptop computer, or PDA (Personal Digital Assistant) that may utilize the services of printer 16. Print server represents generally any hardware and/or programming that enables multiple work stations 12 to simultaneously utilize printer 16. It is noted that that the functions of a work station 12, printer server 14, and printer 16 or only print server 14 and printer 16 could be integrated into a single device.

Work stations 12, print server 14, and printer 16 are interconnected by link 18. Link 18 represents generally a cable, wireless, or remote connection via a telecommunication link, an infrared link, a radio frequency link, and/or any other connector or system that provides electronic communication between devices 12-16. Link 18 may represent an intranet, the Internet, or a combination of both.

Figure 3:
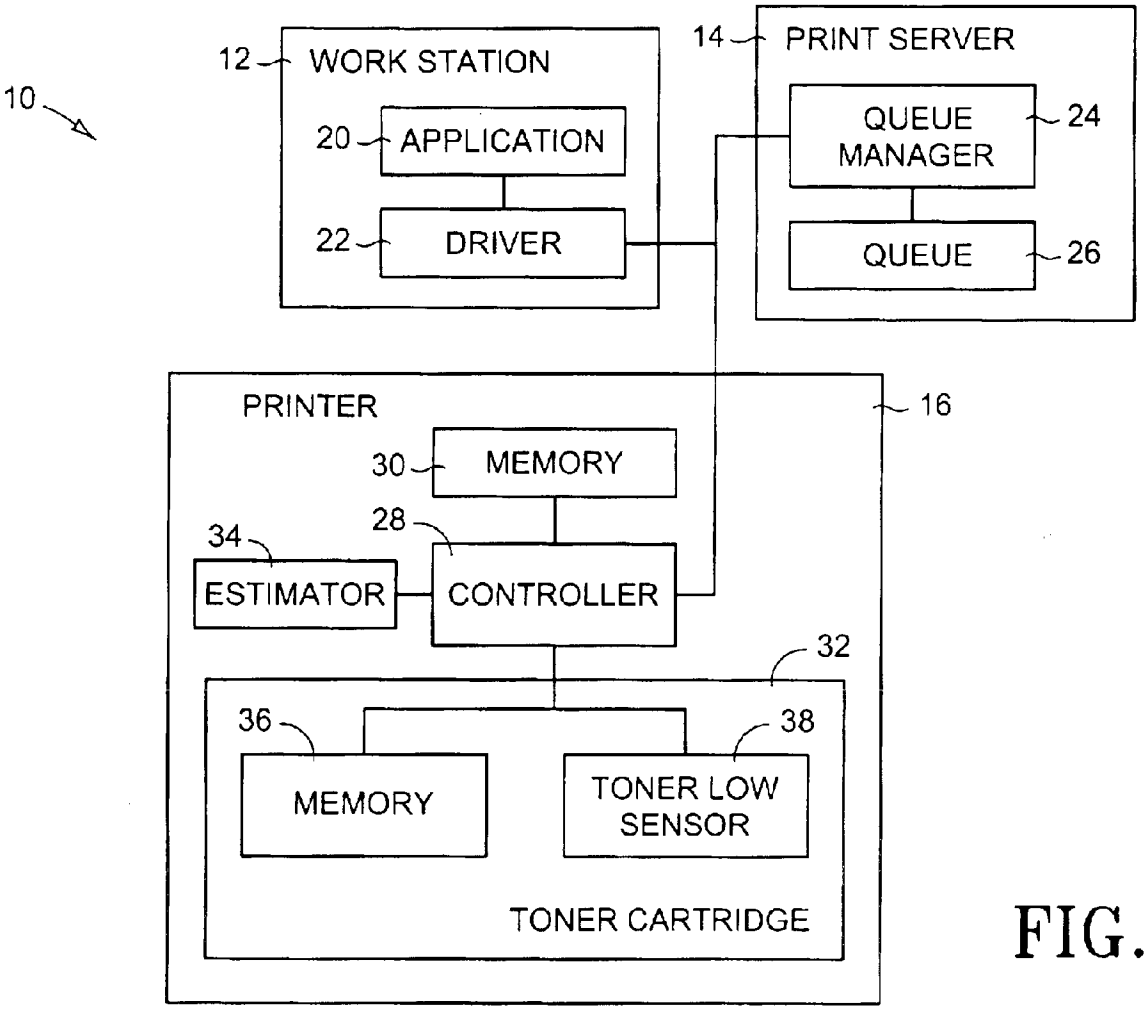
FIG. 3 is a block diagram illustrating physical and logical components of devices shown in FIG. 2 according to an embodiment of the present invention.

COMPONENTS: The logical components of one embodiment of the invention will now be described with reference to the block diagram of FIG. 3. FIG. 3 illustrates the components of work station 12, file server 14, and printer 16. Work station 12 includes application 20 and driver 22. Application 20 represents generally any programming capable of generating printing instructions. For example, application 20 may be a word processor, e-mail client, or graphics editor. Driver 22, then, represents generally any programming capable of translating generic printing instructions generated by application 20 into specific printing commands recognizable by printer 16. In general driver 22 acts as a translator between a device, in this case printer 16, and a program or programs that use the device, in this case application 20. A device such as printer 16 has its own set of specialized commands that that device's driver knows. In contrast, most programs such as application 20 access devices like printer 16 by using generic commands. Driver 22 accepts generic commands from application 20 and then translates them into specialized commands for the printer 16. The specific printing commands for printing a given document are called a print job.

Print server 14 includes queue 24 and queue manager 26. Printers are capable of producing one document at a time. Queue 24 is an electronic holding bin allowing multiple print jobs to be simultaneously directed to printer 16. Queue manager 26 represents generally any programming capable of administering print jobs within queue 24. Upon receipt of a print job from driver 22, queue manager 24 places the print job in queue 24. Queue manager 24 tracks the status of printer 16 and provides driver 22 with the information required to generate a user interface for displaying the status of printer 16, the print jobs in queue 24, as well as user accessible controls for directing how queue manager 26 manipulates print jobs remaining in queue 24. As printer 16 becomes available, queue manager 26 releases print jobs, one at a time, from queue 24.

In addition to other components not shown, printer 16 includes controller 28, memory 30, toner cartridge 32, and estimator 34. Controller 28 represents generally any combination of hardware and/or programming capable of controlling the operation of the other components of printer 16 in order to transform a print job into a printed document. Controller 28 uses memory 30 to store data such as a print job currently being printed.

Toner cartridge 32, configured for communication with controller 28, holds a predetermined amount of toner and is responsible for dispensing measured amounts of toner as directed by controller 28. Estimator 34 represent programming capable of estimating the toner level in toner cartridge 32 and determining whether sufficient toner exists to complete a print job. Estimator 34 is also responsible for issuing alerts to be directed back to a user at work station 12 and/or print server 14. The alert may also be directed to a user interface (not shown) directly controlled by printer 16. The functions and capabilities of estimator 34 will be discussed in more detail with reference to FIGS. 5 and 6 in the following section.

Toner cartridge 32 includes memory 36 and toner sensor 38. Memory 36 is used to store data relating to toner usage and toner levels. Toner sensor 38 represents generally any combination of hardware and/or programming capable of roughly detecting a toner level present within toner cartridge 32. To minimize production costs, toner sensor 38 is preferably capable of sensing a discrete toner level. For example, toner sensor 38 may be an optical sensor that provides a signal when the toner reaches a discrete level—for example—when approximately thirty percent of the toner remains. Of course, toner sensor 38 may instead provide a signal at different a discrete level. U.S. Pat. No. 6,456,802 owned by the Hewlett-Packard Company, provides more information concerning a specific implementation of a discrete toner sensor and is incorporated by reference in its entirety.

Sensor 38 may not be a sensor in the traditional sense of the term. Sensor 38 may serve its function by detecting operating parameters of toner cartridge 32. The components of cartridge 32 are driven by one or more motors. The motor or motors are required to generate varying levels of torque depending upon the level of toner contained in cartridge. Discrete torque levels can be correlated to discrete toner levels. Where a stepper motor is used, the toque level can be identified by sensing the current drawn by the motor. Discrete current levels can then be correlated to discrete toner levels. Where a servo motor is used, the torque level can be identified by sensing the back EMF (Electro Motive Force) generated by the motor. Discrete back EMF levels can be correlated to discrete toner levels. Sensor 38 may, then, sense an operating parameter such as current or back EMF and then identify a toner level associated with that sensed operating parameter. Alternatively, at a known toner level, thirty percent for example, a unique operating parameter will be required to dispense the toner from cartridge 32. Sensor 38 may then detect when the operating parameter reaches that unique level and then send a signal.

Figure 4:
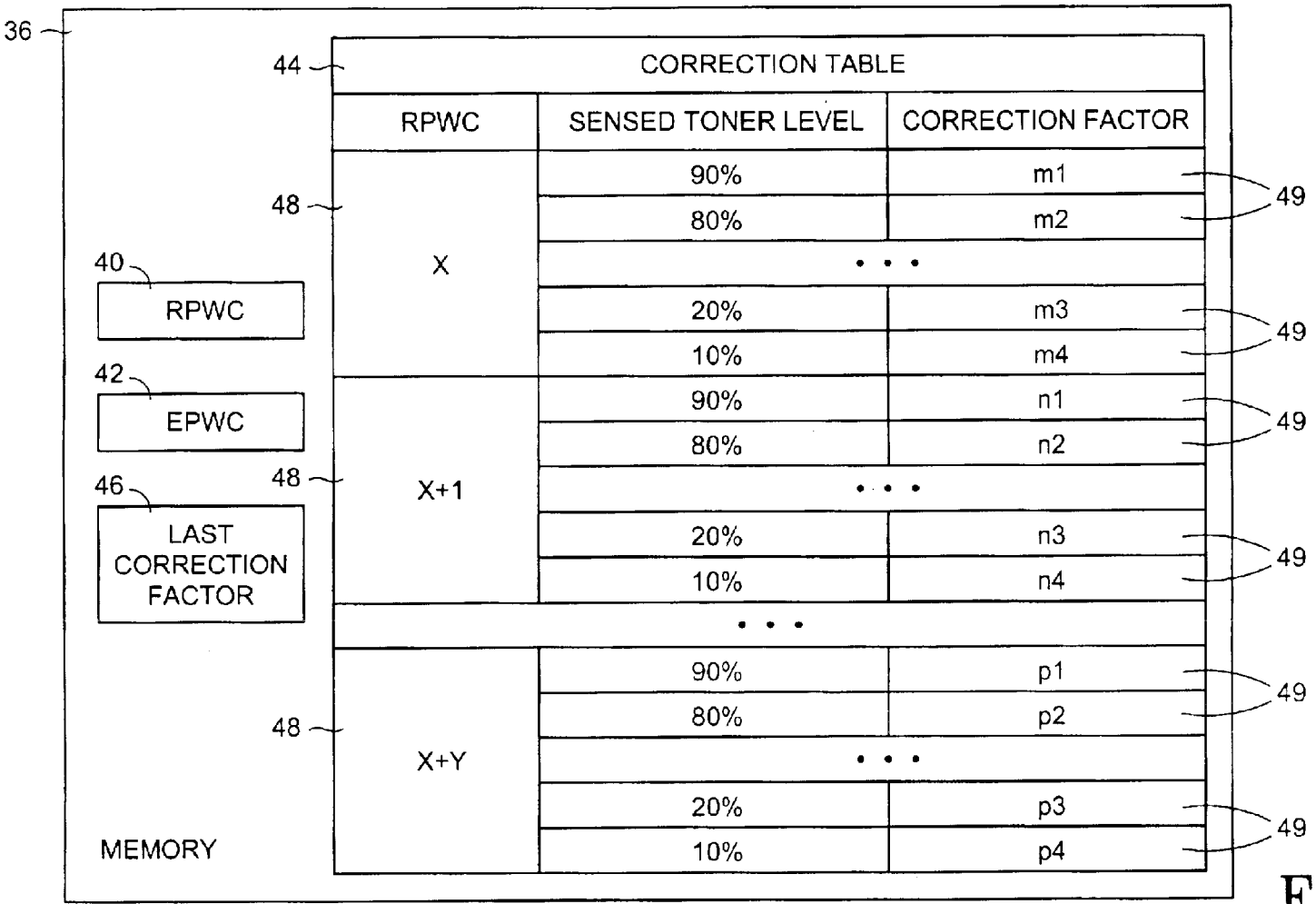
FIG. 4 is a flow diagram illustrating steps taken to infer environmental conditions in order to correct a running pulse width count according to an embodiment of the present invention.

FIG. 4 illustrates the logical elements of memory 36. Memory 36 includes RPWC 40, EPWC 42, correction table 44, and last correction factor 46. RPWC 40 represents the RPWC for toner cartridge 32. EPWC 42 represents the expected pulse width count for toner cartridge 32. The expected pulse width count is a measure of the expected duration of pulses required to deplete a set quantity of toner. Assuming toner cartridge 32 has yet to be used, EPWC 42 is the pulse width count required to deplete the cartridge's toner under set environmental conditions. By comparing RPWC 40 with the EPWC 42, estimator 34 can predict the life remaining in toner cartridge 32. However, as the actual environmental conditions vary from the set conditions, EPWC 42 becomes less accurate.

Correction table 44 represents an array of data used by estimator 34 to look-up a correction factor. A correction factor is a value used by estimator 34 to adjust the EPWC 42 or RPWC 40 so that the two values can be used by estimator 34 to more accurately calculate the available toner in toner cartridge 32. Correction table 44 includes a number of entries 48. Each entry 48 corresponds to an RPWC value. Each entry 48 includes a number of subentries 49. Each subentry 49 corresponds to a sensed toner level and includes a correction factor. Knowing the value for RPWC 40 and the sensed toner level, estimator 34 can look-up the value of a correction factor. Alternatively, correction table 44 could instead be replaced by an equation used calculate a correction factor. Memory 36 also includes last correction factor 46 which represents the value of the most resent correction factor calculated by estimator 34.

For example EPCW 42 may have a value of ten thousand. Toner low sensor 38 sends a signal to estimator 34 that the toner level in toner cartridge is at 30%. In this example, RPWC 40 has a value of six thousand. The difference between EPWC 42 and RPWC 40 is four thousand or forty percent of EPWC 42. This difference indicates that toner cartridge 32 should be forty percent full. However, toner cartridge 32 is only thirty percent full. EPWC 42 needs to be corrected so that it can be used to more accurately estimate the toner remaining in toner cartridge 32.

Estimator 34 could use the following equation to calculate a correction factor:

$$\frac{RPWC}{EPWC*(1-\text{Sensed Toner Level})}$$

The sensed toner level has a value between zero and one rather than a percentage. In the example above the sensed toner level would be 0.3 and the correction factor would be six sevenths or roughly 0.857. Where correction table 44 is used, estimator 34 would first locate an entry 48 in table 44 corresponding to the value of RPWC 40. Estimator 34 would then locate a subentry 49 corresponding to the sensed toner level. In this example, that subentry 49 would contain a correction factor of 0.857.

However it is obtained, the correction factor is stored as last correction factor 46. To estimate toner levels, estimator 32 acquires last correction factor 46 and uses it to adjust EPWC 42. Using the example above, EPWC 42 has a value of ten thousand and the last correction factor has a value of 0.857. Multiplying the two results in a corrected EPWC of 8570. RPCW 40 is seventy percent of the corrected EPWC more accurately indicating that thirty percent of the toner remains in toner cartridge 32. As the value for RPWC 42 increases, estimator 34 can acquire the value of last correction factor 46 to determine a corrected EPWC. Comparing RPWC 42 with the corrected EPWC allows estimator 34 to more accurately estimate the toner level.

It is noted that a given correction factor can have a value less than or equal to one. Where a printer is operating in an environment with a relatively low temperature—for example, ten to fifteen degrees Celsius—and at a low relative humidity of around ten percent, less than expected amounts of toner will be consumed. Consequently, the correction factor will be greater than one in such an environment. Where a printer is operating in an environment with a relatively high temperature, twenty-eight to thirty degrees Celsius, and a high relative humidity of around seventy-five percent, more than expected amounts of toner will be consumed. In such an environment, the correction factor will be less than one.

When less than expected toner is used due to operating in a low temperature, low humidity environment print quality is degraded. Various heating elements such as fusers in laser printers are required to work harder thus decreasing the lifespan of the printer. When excessive toner is used due to operation in a height temperature, high humidity environment, the cost to the consumer is increased. Estimator 34 is also responsible for issuing alerts that inform a user that more or less then expected toner is being used, the possible causes, and the possible effects. Where a correction factor is greater than one, estimator 34 may issue an alert indicating that the print quality will not be up to par and that the printer may be operating in an environment that will decrease its life span. Where a correction factor is less than one, estimator 34 may issue an alert indicating that the environment in which the printer is operating is inflating the user's printing costs.

The block diagrams of FIGS. 3 and 4 show the architecture, functionality, and operation of one implementation of the present invention. Each block may represent in whole or in part a module, segment, or portion of code that comprises one or more executable instructions to implement the specified logical function(s). Each block may represent a circuit or a number of interconnected circuits to implement the specified logical function(s). While components 20–36 are shown operating on three different devices 12, 14, and 16, components 20–36 could be consolidated into a single device such as a copier or facsimile device. The functions of a single component such as estimator 34 may be split among two or more devices.

Figure 6:
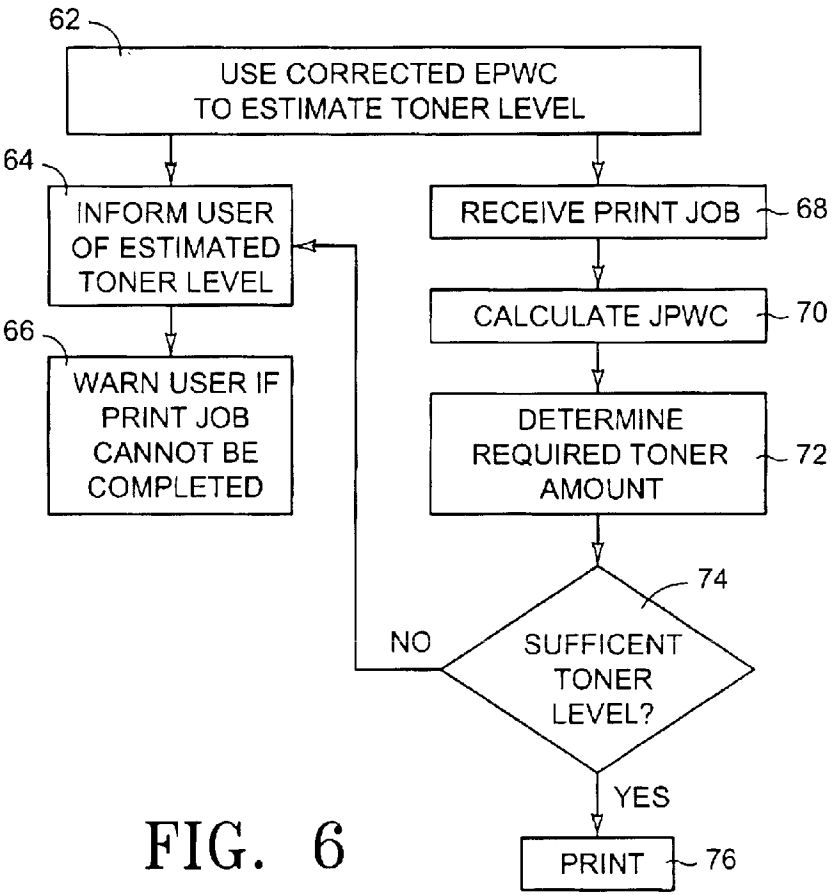
FIG. 6 illustrates steps taken to use a corrected EPWC to estimate toner level and determine if the toner level is sufficient for a print job according to an embodiment of the present invention.
Figure 5:
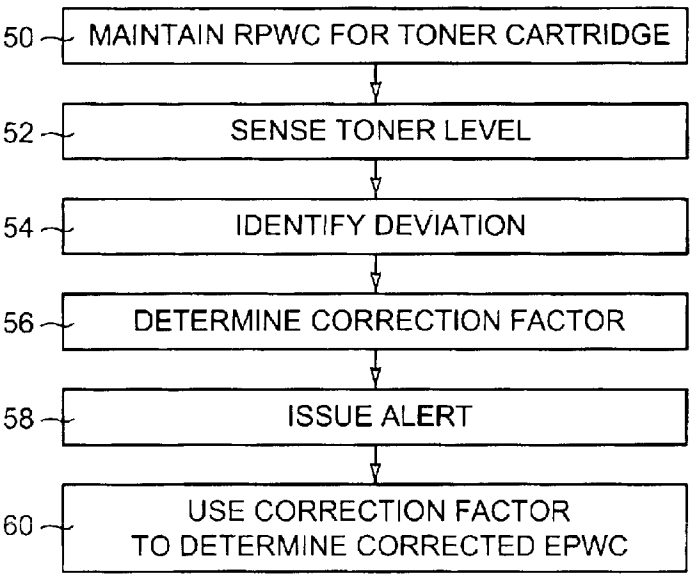
FIG. 5 is a flow diagram illustrating steps taken to estimate toner levels using a corrected running pulse width count according to an embodiment of the present invention.

Also, the present invention can be embodied in any computer-readable media for use by or in connection with an instruction execution system such as a computer/processor based system or other system that can fetch or obtain the logic from the computer-readable media and execute the instructions contained therein. "Computer-readable media" can be any media that can contain, store, or maintain programs and data for use by or in connection with the instruction execution system. Computer readable media can comprise any one of many physical media such as, for example, electronic, magnetic, optical, electromagnetic, infrared, or semiconductor media. More specific examples of suitable computer-readable media include, but are not limited to, a portable magnetic computer diskette such as floppy diskettes or hard drives, a random access memory (RAM), a read-only memory (ROM), an erasable programmable read-only memory, or a portable compact disc. Computer readable media may also refer to signals that are used to propagate the computer executable instructions over a network or a network system such as the Internet OPERATION: The operation of the present invention will now be described with reference to the flow diagrams of FIGS. 5 and 6. FIG. 5 illustrates steps taken to enable application service 12 to correct an expected pulse width Count (EPWC), while FIG. 6 illustrates steps taken to use a corrected EPWC to estimate toner level and determine if the loner level is sufficient for a print job.

Starting with FIG. 5, an RPWC (Running Pulse Width Count) is maintained for a toner cartridge (step 50), and a toner level is sensed (step 52). With reference to FIGS. 3 and 4, RPWC 40 is stored in memory 36 of toner cartridge 32. When toner cartridge 32 is full and before it has been used, RPWC 40 has a zero value. As toner cartridge 32 is used by printer 16 to print documents, estimator 34 calculates and adds a JPWC (Job Pulse Width Count) for each print job. A JPWC is a measure of the duration of pulses required to complete the print job. To maintain RPWC 40, estimator 34 updates memory 36 adding the JPWC for each print job to RPWC 40. To complete step 52, toner low sensor 38 produces a signal representing the toner level within toner cartridge 32. Estimator 34 interprets the signal in order to sense the toner level.

Based on the RPWC, a toner level can be estimated to have a certain value assuming set environmental conditions. A deviation between the estimated and sensed toner levels is identified (step 54) and a correction factor is determined (step 56). With reference to FIGS. 3 and 4, estimator 34 compares the values of EPWC 42 and RPWC 40 to estimate the level of toner in toner cartridge 32. If the estimated toner level differs from the sensed toner level, a deviation is identified. Once a deviation is identified, a correction factor is determined. Estimator 34 is responsible for determining the correction factor and storing its value as last correction factor 46 in memory 36. Estimator 34 can use an equation to calculate the correction factor using JPWC 40, EPWC 42, and the sensed toner level as variables. Alternatively, estimator 34 can use the same variables to look-up a correction factor in correction table 44. Based upon the value of the correction factor, an alert is issued (step 58). As discussed above, the alert may indicate that more or less than expected toner is being consumed, the possible causes, and/or the possible effects.

The correction factor is used to determine a corrected EPWC (step 60). Referring now to FIG. 6, comparing the corrected EPWC with RPWC 40 (shown in FIG. 4), estimator 34 can more accurately estimate and inform a user of remaining toner levels as more print jobs are handled by printer 16 (steps 62 and 64). Estimator 34 sends a signal representing the estimated toner level to driver 22. Driver 22 interprets that signal and causes works station 12 to display a user interface containing data indicating the estimated toner level. The data may indicate a percentage, an expected number of pages that can still be printed using toner cartridge 32, or any other information the user can use to gauge the remaining toner. If a pending print job cannot be completed, driver 22 includes data warning the user in the interface (step 66).

Printer 16 receives a print job (step 68). The JWPC required for that job is calculated (step 70) and used to determine the toner required to produce the print job (step 72). It is then determined whether toner cartridge 32 has a sufficient toner level to complete the print job (step 74). Referring back to FIGS. 3 and 4, controller 28 receives the print job and stores it in memory 30. Estimator 34 examines the print job to determine the JWPC. Estimator 34 acquires the value for RPWC 40 from memory 36 and adds to it the JWPC. If the resulting value exceeds the corrected EPWC, then there is insufficient toner to complete the print job, and the process continues with step 64. If the resulting value does not exceed the corrected EPWC, estimator updates RPWC 40 with the resulting value and the job is printed (step 76).

Although the flow charts of FIGS. 5 and 6 show a specific order of execution, the order of execution may differ from that which is depicted. For example, the order of execution of two or more blocks may be scrambled relative to the order shown. Also, two or more blocks shown in succession may be executed concurrently or with partial concurrence. All such variations are within the scope of the present invention.

The present invention has been shown and described with reference to the foregoing exemplary embodiments. It is to be understood, however, that other forms, details, and embodiments may be made without departing from the spirit and scope of the invention which is defined in the following claims.

What is claimed is:

1. A method for use in conjunction with a printer, the method comprising:

maintaining a running pulse width count;

sensing a toner level;

comparing the running pulse width count with an expected pulse width count to estimate a toner level; and if the estimated toner level deviates from the sensed toner level, using the running pulse width count and the sensed toner level to estimate the toner level.

2. The method of claim 1, wherein using the running pulse width count and the sensed toner level to estimate the toner level comprises:

correcting the expected pulse width count using the sensed toner level end the running pulse width count; and comparing the running pulse width count with the corrected expected pulse width count to estimate the remaining toner level.

3. The method of claim 2, wherein correcting comprises calculating a correction factor and adjusting the expected pulse width count using the correction factor.

4. The method of claim 2, wherein correcting comprises looking-up a correction factor and adjusting the expected pulse width count using the correction factor.

5. The method of claim 2, further comprising continuing to maintain the running pulse width count and comparing the running pulse width count with the corrected expected pulse width count to estimate the toner level.

6. The method of claim 2, further comprising using the corrected expected pulse width count to determine if there is enough toner to complete a print job.

7. The method of claim 1, wherein sensing comprises sensing a discrete toner level.

8. The method of claim 1, wherein sensing comprises sensing operating parameters to identify a toner level.

9. The method of claim 1, further comprising issuing an alert if the estimated toner level deviates from the sensed toner level.

10. A method for use in conjunction with a printer, the method comprising:

maintaining a running pulse width count;

sensing a toner level;

comparing the running pulse width count with an expected pulse width count to estimate a toner level;

if the estimated toner level deviates from the sensed toner level, determining a correction factor using the sensed toner level and the running pulse width count;

correcting the expected pulse width count using the correction factor; end determining if there is sufficient toner to complete a print job using the corrected expected pulse width count.

11. Computer readable media for use in conjunction with a printer, the media having instructions for:

maintaining a running pulse width count:

sensing a toner level;

comparing the running pulse width count with an expected pulse width count to estimate a toner level; and if the estimated toner level deviates from the sensed toner level, using the running pulse width count and the sensed toner level to estimate the toner level.

12. The media of claim 11, wherein the instructions for using the running pulse width count and the sensed toner level to estimate the toner level comprise instructions for:

correcting the expected pulse width count using the sensed toner level and the running pulse width count; and comparing the running pulse width count with the corrected expected pulse width count to estimate the toner level.

13. The media of claim 12, wherein the instructions for correcting comprise instructions for calculating a correction factor and adjusting the expected pulse width count using the correction factor.

14. The media of claim 12, wherein the instructions for correcting comprise instructions for looking-up a correction factor and adjusting the expected pulse width count using the correction factor.

15. The media of claim 12, further comprising instructions for continuing to maintain the running pulse width count and comparing the running pulse width count with the corrected expected pulse width count to estimate the toner level.

16. The media of claim 12, further comprising using the corrected expected pulse width count to determine if there is enough toner to complete a print job.

17. The media of claim 11, wherein the instructions for sensing comprise instructions for sensing a discrete toner level.

18. The media of claim 11, wherein the instructions for sensing comprise instructions for sensing operating parameters to identify a toner level.

19. The media a claim 11, having further instructions for issuing an alert if the estimated toner level deviates from the sensed toner level.

20. Computer readable media for use in conjunction with a printer, the media having instructions for:

maintaining a running pulse width count;

sensing a toner level;

comparing the running pulse width count with an expected pulse width count to estimate a toner level:

if the estimated toner level deviates from the sensed toner level, determining a correction factor using the sensed toner level end the running pulse width count;

correcting the expected pulse width count using the correction factor; and determining if there is sufficient toner to complete a print job using the corrected expected pulse width count.

21. A system for use in conjunction with a printer, comprising:

a stored value representing an expected pulse width count;

a sensor operable to sense a toner level; and an estimator operable to:

maintain a running pulse width count;

compare the running pulse width count with the expected pulse width count to estimate a toner level; and use the running pulse width count and the sensed toner level to estimate the toner level if the estimated toner level deviates from the sensed toner level.

22. The system of claim 21, wherein the estimator is further operable to correct the expected pulse width count using the sensed toner level and the running pulse width count and to compare the running pulse width count with the corrected expected pulse width count to estimate the toner level.

23. The system of claim 22, wherein the estimator is further operable to calculate a correction factor and to correct the expected pulse width count using the correction factor.

24. The system of claim 22, further comprising a correction table, and wherein the estimator is further operable to look-up a correction factor in the correction table and to correct the expected pulse width count using the correction factor.

25. The system of claim 22, wherein the estimator is further operable to use the corrected expected pulse width count to determine if there is enough toner to complete a print job.

26. The system of claim 21, wherein the sensor is a discrete sensor.

27. The system of claim 21, wherein the sensor is operable to sense operating parameters to identity a toner level.

28. A system for use in conjunction with a printer, comprising:

a stored value representing an expected pulse width count;

a sensor operable to sense a toner level; and an estimator operable to:

maintain a running pulse width count;

compare the running pulse width count with the expected pulse width count to estimate a toner level;

use the running pulse width count and the sensed toner level to determine a correction factor if the estimated toner level deviates from the sensed toner level;

correct the expected pulse width count using the correction factor; and determine if there is sufficient toner to complete a print job using the corrected expected pulse width count.

29. A system for use in conjunction with a printer, comprising:

a stored value representing en expected pulse width count:

a means for sensing a toner level;

a means for maintaining a running pulse width count;

a means for comparing the running pulse width count with the expected pulse width count to estimate a toner level;

a means for determining if the estimated toner level deviates from the sensed toner level; and a means for using the running pulse width count and the sensed toner level to estimate the toner level.

30. A system for use in conjunction with a printer, comprising;

a stored value representing an expected pulse width count;

a means for sensing a toner level;

a means for maintaining a running pulse width count;

a means for comparing the running pulse width count with the expected pulse width count to estimate a toner level;

a means far determining if the sensed toner level deviates from the estimated toner level;

a means for determining a correction factor using the sensed toner level and the running pulse width count;

a means for correcting the expected pulse width count using the correction factor; and a means for determining it there is sufficient toner to complete a print job using the corrected expected pulse width count.

* * * * *

UNITED STATES PATENT AND TRADEMARK OFFICE

CERTIFICATE OF CORRECTION

PATENT NO. : 6,925,268 B2
APPLICATION NO. : 10/393837
DATED : August 2, 2005
INVENTOR(S) : Patrick S. Dougherty et al.

It is certified that error appears in the above-identified patent and that said Letters Patent is hereby corrected as shown below:

Column 1, line 49, before "correspondingly" delete "be"

Column 8, Claim 2, line 13, delete "end" and insert therefor --and--

Column 8, Claim 10, line 49, delete "end" and insert therefor --and--

Column 9, Claim 20, line 36, delete "end" and insert therefor --and--

Column 10, Claim 29, line 32, delete "en" and insert therefor --an--

Column 10, Claim 30, line 53, delete "far" and insert therefor --for--

Signed and Sealed this

Twelfth Day of December, 2006

JON W. DUDAS
*Director of the United States Patent and Trademark Office*